US007550059B2

(12) United States Patent
Van Phan et al.

(10) Patent No.: US 7,550,059 B2
(45) Date of Patent: Jun. 23, 2009

(54) TISSUE PAPER PRODUCT

(75) Inventors: Dean Van Phan, West Chester, OH (US); Paul Dennis Trokhan, Hamilton, OH (US); Peter Graves Ayers, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 793 days.

(21) Appl. No.: 10/159,395

(22) Filed: May 30, 2002

(65) Prior Publication Data

US 2002/0179264 A1 Dec. 5, 2002

Related U.S. Application Data

(62) Division of application No. 09/390,974, filed on Sep. 7, 1999, now Pat. No. 6,447,642.

(51) Int. Cl.
*B31F 1/00* (2006.01)

(52) U.S. Cl. ..... 162/109; 162/117; 162/205; 428/156

(58) Field of Classification Search ..... 162/11–113, 162/117, 123–125, 127, 158, 164.1–168.7, 162/204–205; 428/154, 156, 195, 172, 165, 428/152–153; 442/97, 118, 119, 102, 152, 442/165, 412, 414, 417, 130
See application file for complete search history.

(56) References Cited

U.S. PATENT DOCUMENTS

| | | | | | |
|---|---|---|---|---|---|
| 3,537,954 | A | * | 11/1970 | Justus | 162/305 |
| 3,994,771 | A | * | 11/1976 | Morgan, Jr. et al. | 162/113 |
| 4,309,246 | A | | 1/1982 | Hulit et al. | |
| 4,421,600 | A | | 12/1983 | Hostetler | |
| 4,528,239 | A | * | 7/1985 | Trokhan | 442/33 |
| 5,073,235 | A | * | 12/1991 | Trokhan | 162/199 |
| 5,431,786 | A | | 7/1995 | Rasch et al. | |
| 5,503,715 | A | | 4/1996 | Trokhan et al. | |
| 5,514,523 | A | | 5/1996 | Trokhan et al. | |
| 5,554,467 | A | | 9/1996 | Trokhan et al. | |
| 5,556,509 | A | | 9/1996 | Trokhan et al. | |
| 5,580,423 | A | | 12/1996 | Ampulski et al. | |
| 5,609,725 | A | | 3/1997 | Van Phan | |
| 5,629,052 | A | | 5/1997 | Trokhan et al. | |
| 5,637,194 | A | | 6/1997 | Ampulski et al. | |
| 5,674,663 | A | | 10/1997 | McFarland et al. | |
| 5,679,222 | A | | 10/1997 | Rasch et al. | |
| 5,693,187 | A | | 12/1997 | Ampulski et al. | |
| 5,709,775 | A | | 1/1998 | Trokhan et al. | |
| 5,776,312 | A | | 7/1998 | Trokhan et al. | |
| 5,846,380 | A | | 12/1998 | Van Phan et al. | |
| 5,871,887 | A | | 2/1999 | Trokhan et al. | |
| 5,900,122 | A | * | 5/1999 | Huston | 162/348 |
| 5,906,710 | A | * | 5/1999 | Trokhan | 162/109 |
| 5,938,893 | A | | 8/1999 | Trokhan et al. | |
| 5,948,210 | A | * | 9/1999 | Huston | 162/117 |
| 6,010,598 | A | | 1/2000 | Boutilier et al. | |
| 6,117,525 | A | * | 9/2000 | Trokhan et al. | 428/154 |
| 6,860,968 | B1 | * | 3/2005 | Chuang et al. | 162/206 |

FOREIGN PATENT DOCUMENTS

| | | | |
|---|---|---|---|
| EP | 0 140 404 A | | 5/1985 |
| GB | 1589800 A | * | 5/1981 |
| WO | 94/03677 | * | 2/1994 |
| WO | WO 9947749 A1 | * | 9/1999 |

* cited by examiner

*Primary Examiner*—José A Fortuna
(74) *Attorney, Agent, or Firm*—Peter D. Meyer; David K. Mattheis

(57) ABSTRACT

An apparatus and process for removing water from a cellulosic web. The papermaking apparatus comprises imprinting member having an absolute void volume that enables a hydraulic connection to be formed between a cellulosic web and a capillary dewatering member when compressed in a nip. The absolute void volume is predetermined based on an estimate of the volume of water expressed from the cellulosic web.

2 Claims, 1 Drawing Sheet

TISSUE PAPER PRODUCT

This application is a division of Ser. No. 09/390,974 filed Sep. 7, 1999, now U.S. Pat. No. 6,447,642.

FIELD OF THE INVENTION

The present invention relates to papermaking, and more particularly to an apparatus and process for removing water from a cellulosic web.

BACKGROUND OF THE INVENTION

Cellulosic fibrous structures, such as paper towels, facial tissues, napkins and toilet tissues, are a staple of every day life. The large demand for and constant usage of such consumer products has created a demand for improved versions of these products and, likewise, improvement in the methods of their manufacture. Such cellulosic fibrous structures are manufactured by depositing an aqueous slurry from a headbox onto a Fourdrinier wire or a twin wire paper machine. Either such forming wire is an endless belt through which initial dewatering occurs and fiber rearrangement takes place.

After the initial formation of the web, which later becomes the cellulosic fibrous structure, the papermaking machine transports the web to the dry end of the machine. In the dry end of a conventional machine, a press felt compacts the web into a single region, i.e., uniform density and basis weight, cellulosic fibrous structure prior to final drying. The final drying is usually accomplished by a heated drum, such as a Yankee drying drum.

One of the significant improvements to the manufacturing process is the use of through-air-drying to replace conventional press felt dewatering. Through air drying yields significant improvements in consumer products. In through-air-drying, like press felt drying, the web begins on a forming wire which receives an aqueous slurry of less than one percent consistency (the weight percentage of fibers in the aqueous slurry) from a headbox. Initial dewatering takes place on the forming wire. From the forming wire, the web is transferred to an air pervious through-air-drying belt. This "wet transfer" typically occurs at a pickup shoe (PUS), at which point the web may be first molded to the topography of the through air drying belt.

Through air drying yields structured paper having regions of different densities. This type of paper has been used in commercially successful products, such as Bounty paper towels and Charmin and Charmin Ultra brands of bath tissues. Traditional conventional felt drying does not produce the structured paper and its attendant advantages. However, it has been desired to produce structured paper using conventional felt drying at speeds approaching that of the through air dried systems.

Attempts have been made utilizing a conventional felt having a patterned framework thereon for imprinting the embryonic web. Examples of these attempts in the art include commonly assigned U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052, issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; and U.S. Pat. No. 5,709,775 issued Jan. 20, 1998 to Trokhan et al., the disclosures of which are incorporated herein by reference.

Other attempts have been made by transporting a paper web on a separate imprinting fabric and compressing the combination in a compression nip formed between two rolls. U.S. Pat. No. 4,421,600 issued Dec. 20, 1983 to Hostetler discloses an apparatus having two felts, three pressing operations, and a separate woven imprinting fabric. In Hostetler the web is transported on the imprinting fabric through the pressing operations before being delivered to the Yankee dryer.

Another such attempt in the art is illustrated by U.S. Pat. No. 4,309,246 issued Jan. 5, 1982 to Hulit et al. Hulit et al. describes three configurations where a nip is formed between two rolls. In each configuration, a paper web is carried on an imprinting fabric having compaction elements defined by knuckles formed at warp and weft crossover points. The imprinting fabric, web and a felt are compressed between the rolls.

Each of the aforementioned attempts in the art, requires a complex nip system in order to bring the imprinting fabric/paper web combination into contact with a dewatering felt. These systems create very expensive propositions for retrofitting existing conventional machinery, as additional space, drives, etc. are typically required to add the separate felt loop. What's more, in order to sufficiently dewater the paper web, the systems are required to operate at lower speeds than through air dried systems.

Commonly assigned U.S. Pat. No. 5,637,194 issued Jun. 10, 1997 to Ampulski et al., the disclosure of which is incorporated herein by reference, discloses an alternative paper machine embodiment where a first dewatering felt is positioned adjacent a face of the imprinting member as the molded web is carried on the imprinting member from a first compression nip formed between two pressure rolls and a second dewatering felt to a second compression nip formed between a pressure roll and a Yankee drying drum. The imprinting member imprints the molded web and carries it to the Yankee drying drum. The presence of the first felt adjacent the imprinting member at the two compression nips results in additional water removal from the web prior to transfer to the Yankee drum.

The present invention provides a web patterning apparatus suitable for making structured paper on a conventional papermaking machine without the need for an additional dewatering felt or compression nip. The invention provides a web patterning apparatus capable of dewatering a paper web using conventional felt dewatering techniques with a single compression nip system while operating at speeds approaching that of through air dried systems.

SUMMARY OF THE INVENTION

The invention comprises papermaking apparatus and process for removing water from a cellulosic web. The papermaking apparatus comprises an imprinting member having an absolute void volume that enables a hydraulic connection to be formed between a cellulosic web and a capillary dewatering member when compressed in a nip. The absolute void volume is predetermined based on an estimate of the volume of water expressed from the cellulosic web at the nip. For the present invention, the ratio of the volume of water expelled from the web to the absolute void volume of the imprinting member is at least about 0.5.

The nip can be formed between first and second rolls juxtaposed coaxially. The cellulosic web is carried on the topside of the imprinting member. The cellulosic web and imprinting member are interposed in the nip such that the top surface of the cellulosic web is in contacting relationship with the periphery of the first roll. In the nip, the backside of the imprinting member is in contacting relationship with the top surface of a capillary dewatering member while the back surface of the capillary dewatering member is in contacting relationship with the periphery of the second roll. The nip compresses the paper web, the imprinting member, and the capillary dewatering member. Water expelled from the web passes through the imprinting member to the capillary dewatering member forming a hydraulic connection therebetween.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Definitions

As used herein, the following terms have the following meanings:

Hydraulic connection is a continuous link formed by water or other similar liquid.

Void volume (VV) is the open space providing a path for fluids.

Relative Void Volume ($VV_{Relative}$) is the ratio of VV to the Total Volume of space occupied by a given sample.

Absolute Void Volume ($VV_{Absolute}$) is the volumetric measure of VV per unit area in $cm^3/cm^2$.

Machine direction, designated MD, is the direction parallel to the flow of the cellulosic web through the product manufacturing equipment.

Cross machine direction, designated CD, is the direction perpendicular to the machine direction in the same plane of the cellulosic web.

Capillary dewatering member is a device for removing water via capillary attraction.

Caliper is the macroscopic thickness of a sample measured as described below.

Basis weight (BW) is the weight of cellulosic fibers (in grams, g) per unit area ($cm^2$) of a sample of a cellulosic web reported in $g/cm^2$.

Also, as used herein, paper web is synonymous with cellulosic web.

Figure 1:
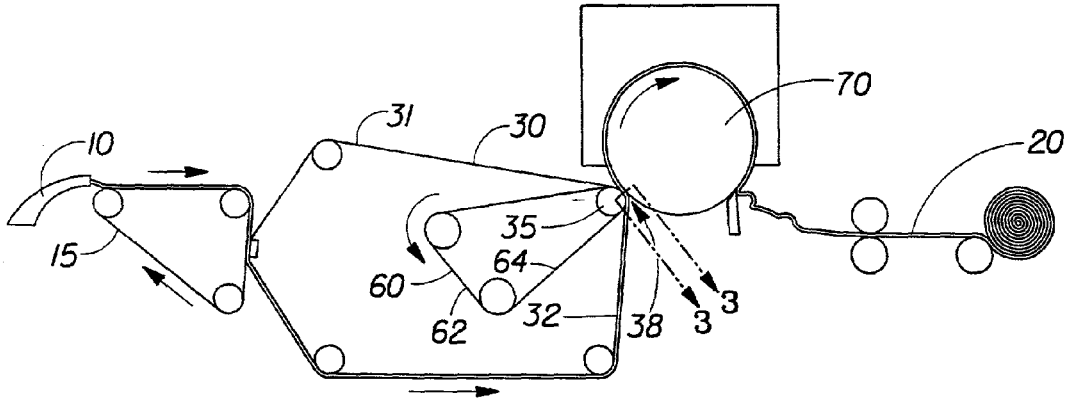
FIG. 1 is a vertical side elevational view of a papermaking machine according to the present invention.

The present invention comprises an apparatus for dewatering a cellulosic web 20. Referring to FIG. 1, an aqueous slurry comprising cellulosic fibers and water is discharged from a headbox 10 onto a forming wire 15 and then transferred to a drying apparatus comprising an imprinting member 30 shown as an endless belt. The imprinting member 30 carries the cellulosic web 20 containing a volume of water to a nip 38 formed between two coaxial rolls. The first roll 70 can be heated roll such as a Yankee drying drum as shown in FIG. 1. The second roll 35 can be a pressure roll having a periphery with a capillary dewatering member 60 disposed thereon. The capillary dewatering member 60 can be a felt and the pressure roll can be a vacuum pressure roll.

The capillary dewatering member 60 includes a top surface 62 and a bottom surface 64. In the nip 38, the bottom surface 64 of the capillary dewatering member 60 interfaces with the second roll 35 while the top surface 62 interfaces with a backside 32 of the imprinting member 30 such that the cellulosic web 20 carried on the topside 31 of the imprinting member 30 interfaces with the first roll 70. The nip 38 compresses the capillary dewatering member 60, imprinting member 30 and cellulosic web 20 combination, squeezing a volume of water from the web, through the imprinting member 30 to the capillary dewatering member 60. At the same time, the imprinting member 30 imprints the cellulosic web while transferring it to the Yankee drying drum 70.

If desired, a vacuum may be applied through the second roll 35 to the capillary dewatering member 60. This vacuum assists in water removal from the capillary dewatering member 60, and hence from the cellulosic web 20. The second roll 35 may be a vacuum pressure roll. A steam box is disposed opposite the vacuum pressure roll 35. The steam box ejects steam through the cellulosic web 20. As the steam passes through and/or condenses in the cellulosic web 20, it elevates the temperature and reduces the viscosity of water contained therein, promoting better dewatering. The steam and/or condensate is collected by the vacuum pressure roll 35.

Of course, one of ordinary skill will recognize that the simultaneous imprinting, dewatering and transfer operations may occur in embodiments other than these requiring a Yankee drying drum 70. For example, two flat surfaces may be juxtaposed together to form an elongate nip 38 therebetween. Alternatively, two rolls may be utilized, neither of which roll is heated. The rolls may be, for example, part of a calendar stack, or an operation which prints a functional additive onto the surface of the web. Functional additives include: lotions emollients, dimethicones, softeners, perfumes, menthols, etc. which are well known in the art.

It has been found that for a given imprinting member 30 the amount of water removed from the cellulosic web 20 in the nip 38 is directly related to the hydraulic connection formed between the cellulosic web 20 and the capillary dewatering member 60 via the imprinting member 30. The imprinting member 30 has an absolute void volume which can be designed to optimize the hydraulic connection and maximize corresponding water removal.

The amount of water in a cellulosic web 20 is evaluated in terms of consistency which is the percentage by weight of cellulosic fibers making up a web of fibers and water. Consistency is determined by the following expression $$\text{Consistency} = \frac{\text{g of Fibers}}{\text{g of Fibers} + \text{g of Water}}$$

and $$\frac{\text{g of Water}}{\text{g of Fibers}} = \frac{1}{\text{Consistency}} - 1$$

Upon entering the nip 38, a cellulosic web 20 can have an ingoing consistency of about 0.22 comprising about 4.54 g of water/g of fibers. The desired consistency for a cellulosic web 20 exiting the nip 38 is about 0.40 comprising about 2.50 g of water/g of fibers. Thus about 2.04 g of water/g of fibers is removed at the nip. Given the Basis weight of the cellulosic web upon exiting the nip, the volume of water expelled at the nip is determined by the following:

$$V_{water\ per\ unit\ area} = \frac{\text{g of Water}}{\text{g of fibers}} \times BW \frac{\text{g of fibers}}{\text{cm}^2} \times \frac{1}{\rho_{water}}$$

where

BW=basis weight of the web exiting the nip.

$\rho_{water}$=density of water=(1 $g/cm^3$)

In order to maximize water removal at the nip, the ratio of the volume of water expelled from the cellulosic web 20 to the absolute void volume of the imprinting member 30 is at least about 0.5. The ratio of the volume of water expelled from the cellulosic web 20 to the absolute void volume of the imprinting member 30 can be at least about 0.7. In some embodiments, the ratio can be greater than 1.0.

The imprinting member can comprise woven fabric. Woven fabrics typically comprise warp and weft filaments where warp filaments are parallel to the machine direction and weft filament are parallel to the cross machine direction. The warp and weft filaments form discontinuous knuckles where the filaments cross over one another in succession. These discontinuous knuckles provide discrete imprinted areas in the cellulosic web 20 during the papermaking process. As used herein the term "long knuckles" is used to define discontinuous knuckles formed as the warp and weft filaments cross over two or more warp or weft filament, respectively.

The knuckle imprint area of the woven fabric may be enhanced by sanding the surface of the filaments at the warp and weft crossover points. Such sanded woven fabrics are made in accordance with the teachings of U.S. Pat. No. 3,573,164, issued to Friedberg et al. on Mar. 30, 1971 and U.S. Pat. No. 3,905,863 issued to Ayers on Sep. 16, 1975 both of which are incorporated herein by reference.

Absolute void volume of the woven fabric can be determined by measuring caliper and weight of a sample of woven fabric of known area. The caliper is measured by placing the sample of woven fabric on a horizontal flat surface and confining it between the flat surface and a load foot having a horizontal loading surface, where the load foot loading surface has a circular surface area of about 3.14 square inches and applies a confining pressure of about 15 g/cm$^2$ (0.21 psi) to the sample. The caliper is the resulting gap between the flat surface and the load foot loading surface. Such measurements can be obtained on a VIR Electronic Thickness Tester Model II available from Thwing-Albert, Philadelphia, Pa.

The density of the filaments is determined while the density of the void spaces is assumed to be 0 gm/cc. For example, polyester (PET) filaments have a density of 1.38 g/cm$^3$. The sample of known area is weighed, thereby yielding the mass of the test sample. The absolute void volume ($VV_{Absolute}$) per unit area of woven fabric is then calculated by the following formula (with unit conversions where appropriate):

$$VV_{Absolute} = V_{total} - V_{filaments}$$
$$= (t \times A) - (m/r)$$

where, $V_{total}$=total volume of test sample (t x A).

$V_{filaments}$=solid volume of the woven fabric equal to the volume of the constituent filaments alone.

t=caliper of test sample.

A=area of test sample.

m=mass of test sample.

r=density of filaments

Relative void volume is determined by the following:

$$VV_{Relative} = \frac{VV_{Absolute}}{V_{Total}}$$

For the present invention, maximum water removal at the nip can be achieved for a woven fabric where the $VV_{Relative}$ ranges from a low limit of about 0.05, preferably a low limit of 0.10, to a high limit of about 0.45, preferably a high limit of about 0.4. For a sanded woven fabric the high limit of $VV_{Relative}$ is about 0.30.

Figure 2:
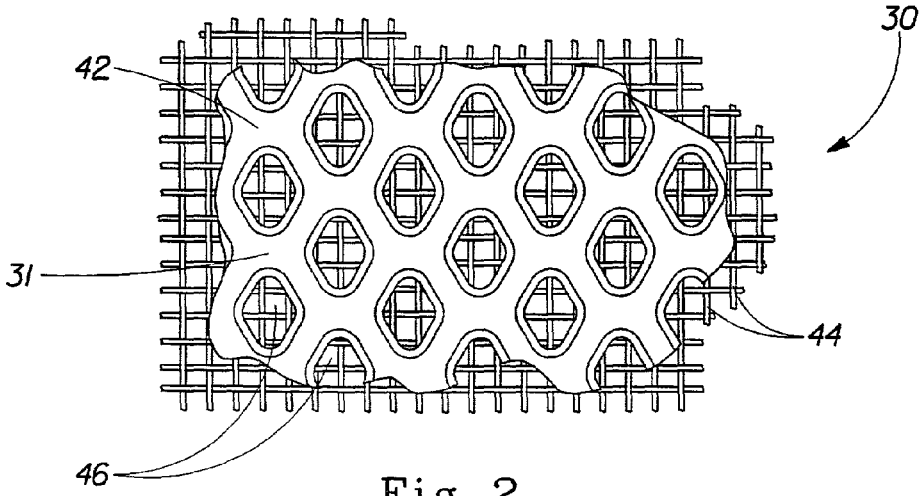
FIG. 2 is a fragmentary top plan view of the imprinting member shown in FIG. 1.
Figure 3:
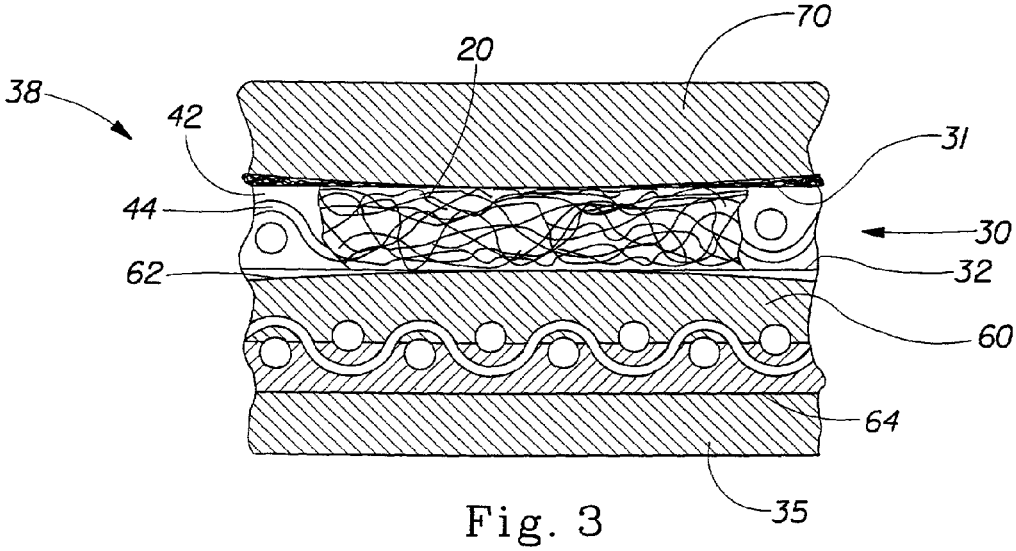
FIG. 3 is a vertical sectional view taken along lines 3-3 of FIG. 1.

FIG. 2 illustrates an imprinting member 30 wherein the woven fabric serves as a reinforcing structure for a resinous knuckle pattern 42. FIG. 3 illustrates a cross section of unit cell of an imprinting member 30 in a compression nip 38 formed between a Yankee drum 70 and a pressure roll 35. The imprinting member 30 has a topside 31 in contacting relationship with the cellulosic web 20 and a back side 32 in contacting relationship with a capillary dewatering member 60. For this embodiment, the knuckle pattern 42 defines deflection conduits 46. The capillary dewatering member 60 comprises a dewatering felt. In the nip 38, the knuckle pattern 42 compress the cellulosic web 20 compacting the fibers while simultaneously forcing the water into the deflection conduits 46. In the deflection conduits 46, the water flows through the absolute void volume of the reinforcing structure forming a hydraulic connection with the capillary dewatering member. The cellulosic fibers become captured by the solid volume of the reinforcing structure 44 forming low density pillow areas in the cellulosic web 20.

The $VV_{Absolute}$ of an imprinting member 30 having a resinous knuckle pattern 42 as shown in FIG. 2, is determined by immersing a sample of the imprinting member 30 in a bath of melted Polyethylene Glycol 1000 (PEG) to a depth slightly exceeding the thickness of the sample. After assuring that all air is expelled from the immersed sample, the PEG is allowed to resolidify. The PEG above the topside 31, below the backside 32 and along the edges of the sample is removed from the sample and the sample is reweighed. The difference in weight between the sample with and without PEG is the weight of the PEG filling the absolute void volume. The absolute void volume and the solid volume of the sample is determined by the following expressions:

$$VV_{Absolute} = \frac{\text{grams of PEG}}{\rho_{PEG}}$$

where $$\rho_{PEG} = \text{density of PEG}$$

$$SV_{Absolute} = V_{Filaments} + V_{Resinous\ Knuckles} = \frac{m_{filaments}}{r_{filaments}} + \frac{M_{Restinous\ Knuckles}}{\rho_{Resinous\ Knuckles}}$$

where $SV_{Absolute}$=Absolute Solid Volume $m_{filaments}$=mass of filaments $r_{filaments}$=density of filaments $M_{Resinous\ Knuckles}$=mass of the resinous knuckles $\rho_{Resinous\ Knuckles}$=density of resinous knuckles For the present invention, maximum water removal at the nip can be achieved for a reinforcing structure 42 having a resinous knuckle pattern 44 disposed thereon where the $VV_{Relative}$ ranges from a low limit of about 0.05, preferably a low limit of 0.10, to a high limit of about 0.45, preferably a high limit of about 0.28. Most preferably, the $VV_{Relative}$ for a reinforcing structure having a resinous knuckle pattern disposed thereon is about 0.19.

Imprinting Member

The imprinting member 30 can be an imprinting fabric. The imprinting fabric is macroscopically monoplanar. The plane of the imprinting fabric defines its X-Y directions. Perpendicular to the X-Y directions and the plane of the imprinting fabric is the Z-direction of the imprinting fabric. Likewise, the cellulosic web 20 according to the present invention can be thought of as macroscopically monoplanar and lying in an X-Y plane. Perpendicular to the X-Y directions and the plane of the web is the Z-direction of the cellulosic web 20.

The imprinting fabric includes a topside 31 which contacts the cellulosic web 20 that is carried thereon and a backside 32 which contacts the dewatering felt. The imprinting fabric comprises a woven fabric comparable to woven fabrics commonly used in the papermaking industry for imprinting fabrics. Such imprinting fabrics which are known to be suitable for this purpose are illustrated in commonly assigned U.S. Pat. No. 3,301,746 issued Jan. 31, 1967 to Sanford et al.; U.S. Pat. No. 3,905,863 issued Sep. 16, 1975 to Ayers; and U.S. Pat. No. 4,239,065 issued Dec. 16, 1982 to Trokhan, the disclosures of which are incorporated herein by reference.

The filaments of the woven fabric may be so woven and complimentarily serpentinely configured in at least the Z-direction of the lamina to provide a first grouping or array of coplanar top-surface-plane crossovers of both warp and weft filaments and a predetermined second grouping or array of sub-top-surface crossovers. The arrays are interspersed so that portions of the top-surface-plane crossovers define an array of wicker-basket-like cavities in the top surface of the fabric. The cavities are disposed in staggered relation in both the machine direction and the cross machine direction such that each cavity spans at least one sub-top-surface crossover. A woven fabric having such arrays may be made according to commonly assigned U.S. Pat. No. 4,239,065, issued Dec. 16, 1980 to Trokhan; and U.S. Pat. No. 4,191,069, issued Mar. 4, 1980 to Trokhan, the disclosures of which are incorporated herein by reference.

For a woven fabric the term shed is used to define the number of warp filaments involved in a minimum repeating unit. The term "square weave" is defined as a weave of n-shed wherein each filament of one set of filaments (e.g., wefts or warps), alternately crosses over one and under n−1 filaments of the other set of filaments (e.g. wefts or warps) and each filament of the other set of filaments alternately passes under one and over n−1 filaments of the first set of filaments.

The woven fabric for the present invention is required to form and support the cellulosic web 20 and allow water to pass through. The woven fabric for the imprinting fabric can comprise a "semi-twill" having a shed of 3 where each warp filament passes over two weft filaments and under one weft filament in succession and each weft filament passes over one warp filament and under two warp filaments in succession. The woven fabric for the imprinting fabric may also comprise a "square weave" having a shed of 2 where each warp filament passes over one weft filament and under one weft filament in succession and each weft filament passes over one warp filament and under one warp filament in succession.

The caliper of the woven fabric may vary, however, in order to facilitate the hydraulic connection between the cellulosic web 20 and the capillary dewatering member 60 the caliper of the imprinting fabric should range from about 0.011 inch (0.279 mm) to about 0.026 inch (0.660 mm).

In an alternative embodiment of the present invention, the imprinting fabric may comprise a multi-layer fabric having at least two layers of interwoven yarn, a cellulosic web 20 facing first layer and a dewatering felt facing second layer opposite the first layer. Each layer of the interwoven yarns is further comprised of interwoven warp and weft yarns. For this embodiment, the first lamina further comprises tie yarns interwoven with the respective yarns of the cellulosic web 20 facing layer and the dewatering felt facing layer. Illustrative belts having multiple layers of interwoven yarns are found in commonly assigned U.S. Pat. No. 5,496,624 issued Mar. 5, 1996 to Stelljes et al. U.S. Pat. No. 5,500,277 issued Mar. 19, 1996 to Trokhan et al. and U.S. Pat. No. 5,566,724 issued Oct. 22, 1996 to Trokhan et al. the disclosures of which are incorporated herein by reference.

The woven fabric of the imprinting fabric may serve as a reinforcing structure 44 for the belt and provide support for a knuckle pattern 42 as illustrated in FIG. 2. Such knuckle pattern preferably comprises a cured polymeric photosensitive resin disposed on the cellulosic web 20 contacting surface of the reinforcing structure 42.

Preferably the knuckle pattern 42 defines a predetermined pattern which imprints a like pattern onto the paper which is carried thereon. A particularly preferred pattern for the knuckle pattern 42 is an essentially continuous network. If the preferred essentially continuous network pattern is selected for the knuckle pattern 42, discrete deflection conduits will extend between the first surface and the second surface of the imprinting fabric. The essentially continuous network surrounds and defines the deflection conduits.

The projected surface area of the continuous network top surface can provide about 5 to about 80 percent of the projected area of the cellulosic web 20 contacting surface 22 of the imprinting fabric and is preferably about 25 percent to about 75 percent of the web contacting surface 22 and still more preferably about 50 to about 65 percent of the web contacting surface 22.

The reinforcing structure 44 provides support for the knuckle pattern 42 and can comprise of various configurations, as previously described. Portions of the reinforcing structure 44 prevent fibers used in papermaking from passing completely through the deflection conduits and thereby reduces the occurrences of pinholes. If one does not wish to use a woven fabric for the reinforcing structure, a nonwoven element, screen, net, or a plate having a plurality of holes therethrough may provide adequate strength and support for the knuckle pattern 42 of the present invention.

The imprinting fabric having the knuckle pattern 42 disposed thereon according to the present invention may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; and U.S. Pat. No. 5,628,876, issued May 13, 1997 to Ayers et al., the disclosures of which are incorporated herein by reference.

Preferably, the knuckle pattern 42 extends outwardly from the knuckles of the reinforcing structure a distance less than about 0.15 millimeters (0.006 inch), more preferably less than about 0.10 millimeters (0.004 inch) and still more preferably less than about 0.05 millimeters (0.002 inch). The knuckle pattern 42 can be approximately coincident the elevation of the knuckles of the reinforcing structure 44. By having the knuckle pattern 42 extending outwardly such a short distance from the reinforcing structure, a softer product may be produced. Specifically, the short distance provides for the absence of deflection or molding of the paper into the imprinting surface of the imprinting fabric as occurs in the prior art. Thus, the resulting paper will have a smoother surface and less tactile roughness.

Furthermore, by having the knuckle pattern 42 extend outwardly from the reinforcing structure such a short distance, the reinforcing structure will contact the paper at top surface knuckles disposed within the deflection conduits. This arrangement further compacts the paper at the points coincident the knuckles against the Yankee drying drum, decreasing the X-Y spacing between compacted regions.

Thus, more frequent and closely spaced contact between the cellulosic web 20 and the Yankee occurs. One of the benefits of the present invention is that the imprinting of the web and transfer to the Yankee occur simultaneously, eliminating the multi-operational steps involving separate compression nips of the prior art. Also, by transferring substantially full contact of the paper to the Yankee—rather than just the imprinted region as occurs in the prior art—full contact drying can be obtained.

If desired, in place of the imprinting fabric having the knuckle pattern 42 described above, a belt having a jacquard weave or dobby weave may be utilized. Such a belt may be utilized as an imprinting member 30 or reinforcing structure. Illustrative belts having a jacquard weave or dobby weave are found in U.S. Pat. No. 5,429,686 issued Jul. 4, 1995 to Chiu et al. and U.S. Pat. No. 5,672,248 issued Sep. 30, 1997 to Wendt et al.

Capillary Dewatering Member

The capillary dewatering member 60 can be a dewatering felt. The dewatering felt is macroscopically monoplanar. The plane of the dewatering felt defines its X-Y directions. Perpendicular to the X-Y directions and the plane of the dewatering felt is the Z-direction of the second lamina.

A suitable dewatering felt comprises a nonwoven batt of natural or synthetic fibers joined, such as by needling, to a secondary base formed of woven filaments. The secondary base serves as a support structure for the batt of fibers. Suitable materials from which the nonwoven batt can be formed include but are not limited to natural fibers such as wool and synthetic fibers such as polyester and nylon. The fibers from which the batt is formed can have a denier of between about 3 and about 20 grams per 9000 meters of filament length.

The dewatering felt can have a layered construction, and can comprise a mixture of fiber types and sizes. The layers of felt are formed to promote transport of water received from the web contacting surface of the imprinting member 30 away from a first felt surface and toward a second felt surface. The felt layer can have a relatively high density and relatively small pore size adjacent the felt surface in contact with the backside 32 of the imprinting member 30 as compared to the density and pore size of the felt layer adjacent the felt surface in contact with the pressure roll 35.

The dewatering felt can have an air permeability of between about 5 and about 300 cubic feet per minute (cfm) (0.002 $m^3$/sec-0.142 $m^3$/sec) with an air permeability of less than 50 cfm (0.24 $m^3$/sec) being preferred for use with the present invention. Air permeability in cfm is a measure of the number of cubic feet of air per minute that pass through a one square foot area of a felt layer, at a pressure differential across the dewatering felt thickness of about 0.5 inch (12.7 mm) of water. The air permeability is measured using a Valmet permeability measuring device (Model Wigo Taifun Type 1000) available from the Valmet Corp. of Helsinki, Finland.

If desired, other capillary dewatering members may be used in place of the felt 60 described above. For example, a foam capillary dewatering member may be selected. Such a foam has an average pore size of less than 50 microns. Suitable foams may be made in accordance with commonly assigned U.S. Pat. No. 5,260,345 issued Nov. 9, 1993 to DesMarais et al. and U.S. Pat. No. 5,625,222 issued Jul. 22, 1997 to DesMarais et al., the disclosures of which are incorporated herein by reference.

Alternatively, a limiting orifice drying medium may be used as a capillary dewatering member. Such a medium may be made of various laminae, superimposed in face to face relationship. The laminae have an interstitial flow area smaller than that of the interstitial areas between fibers in the paper. A suitable limiting orifice drying member may be made in accordance with commonly assigned U.S. Pat. No. 5,625,961 issued May 6, 1997 to Ensign et al. and U.S. Pat. No. 5,274,930 issued Jan. 4, 1994 to Ensign et al., the disclosures of which are incorporated herein by reference.

The cellulosic web 20 may also be foreshortened, as is known in the art. Foreshortening can be accomplished by creping the web 20 from a rigid surface, and preferably from a cylinder. A Yankee drying drum 70 is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference.

The Paper

The tissue paper produced according to the present invention is macroscopically monoplanar where the plane of the paper defines its X-Y directions and having a Z direction orthogonal thereto. The tissue paper of the present invention has two regions. The first region comprises an imprinted region which is imprinted against the knuckle pattern 42 of the imprinting member 30. The second region of the paper comprises a plurality of domes dispersed throughout the imprinted region. The domes generally correspond in geometry, and during papermaking, in position to the deflection conduits 46 in the imprinting member 30.

The first region can comprise a plurality of imprinted regions. The first plurality of regions lie in X-Y plane; and the second plurality of regions extend outwardly from the X-Y plane. The second plurality of regions has a lower density than the first plurality of regions. The density of the first and second regions can be measured according to U.S. Pat. No. 5,277,761 issued to Phan et al. Jan. 11, 1994 and U.S. Pat. No. 5,443,691 issued to Phan et al. Apr. 22, 1995 both of which are incorporated herein by reference.

During foreshortening as described above, at least one foreshortening ridge is produced in the second plurality of regions. Such at least one foreshortening ridge is spaced apart from the plane in the Z direction.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

REFERENCE NUMERALS

10 headbox
20 cellulosic web
15 forming wire
30 imprinting member
31 topside of the imprinting member
32 backside of the imprinting member
35 second roll, pressure roll
38 nip
42 knuckle pattern
44 reinforcing structure
46 deflection conduits
60 capillary dewatering member
62 top surface of capillary dewatering member
64 bottom surface of capillary dewatering member
70 Yankee drying drum

What is claimed is:

1. A tissue paper defining an X-Y plane and having a Z-direction orthogonal thereto, the tissue paper comprising a first plurality of regions, the first plurality of regions lying in a plane; and a second plurality of discrete regions extending outwardly from the plane, the second plurality of regions having a lower density than the first plurality of regions, the second plurality of discrete regions having at least one foreshortening ridge disposed therein, the at least one foreshortening ridge being spaced apart from the plane in the Z-direction.

2. Tissue paper according to claim 1 which is uncreped.

* * * * *